US005088578A

United States Patent [19]

Gates

[11] Patent Number: 5,088,578

[45] Date of Patent: Feb. 18, 1992

[54] MOVABLE SUPPORT MECHANISM FOR CONSTRUCTION OF ELEVATOR SHAFTS AND THE LIKE

[75] Inventor: H. Gordon Gates, Lakewood, Colo.

[73] Assignee: Gates & Sons, Inc., Denver, Colo.

[21] Appl. No.: 586,310

[22] Filed: Sep. 21, 1990

Related U.S. Application Data

[63] Continuation-in-part of Ser. No. 364,229, Jun. 12, 1989, Pat. No. 4,974,700.

[51] Int. Cl.[5] ..... E04G 3/00

[52] U.S. Cl. ..... 182/128; 182/146; 249/20; 425/65

[58] Field of Search ..... 182/128, 146; 249/20; 425/65; 248/544, 675, 672, 201, 200.1, 354.3, 351

[56] References Cited

U.S. PATENT DOCUMENTS

| | | | |
|---|---|---|---|
| 1,591,907 | 7/1926 | Yager | 249/20 |
| 1,685,012 | 9/1928 | Yager | 249/20 |
| 3,574,905 | 4/1971 | Jing-Hong | 249/20 |
| 3,841,596 | 10/1974 | Cull | 425/65 |
| 3,973,885 | 8/1976 | Schmidt | 249/22 |

FOREIGN PATENT DOCUMENTS

| | | | |
|---|---|---|---|
| 391248 | 9/1971 | U.S.S.R. | 182/128 |

*Primary Examiner*—Karen J. Chotkowski

*Attorney, Agent, or Firm*—Fields, Lewis, Pittenger & Rost

[57] ABSTRACT

The invention also contemplates a retractable corner mechanism for the inside corner of the concrete form. The mechanism comprises an elongated corner member having first and second perpendicular faces joined along a first edge of each face to form a corner and having form attaching means along a second edge. A concrete form has an end attached to each of the second edges. Means are provided for sliding the forms relative to the corner member and means is provided for retracting and extending the forms to cause the corner member to be retracted and extended. The forms can be made of plywood or metal and the use of steel is contemplated for the corner members. The retracting and extending means can include an externally threaded rod pivotally connected adjacent the end of one of the concrete forms and an internally threaded member pivotally connected adjacent the end of the other of the concrete forms and treadably received on the rod. Means is provided for rotating the threaded member on the rod to retract or extend the concrete forms.

11 Claims, 7 Drawing Sheets

MOVABLE SUPPORT MECHANISM FOR CONSTRUCTION OF ELEVATOR SHAFTS AND THE LIKE

TECHNICAL FIELD

This invention is a continuation-in-part of U.S. Ser. No. 364,229, filed June 12, 1989 now U.S. Pat. No. 4,974,700 which relates to a movable support mechanism and more particular to such a mechanism which can support the interior forms for pouring concrete wall sections in an elevator shaft or the like and which can easily be moved upwardly as each section is poured and cured. The present invention is directed to a retractable corner mechanism which is particularly usable with this form support mechanism.

BACKGROUND ART

Before the present invention, the erection of forms in the interior of an elevator shaft, stairway shaft and the like was cumbersome and time consuming. One way to position the forms was to erect a semi-permanent super structure under the forms at each floor level until the walls for that level were formed and then build additional super structure on top of the original super structure to get up to the next floor and so on. An alternative method was to erect the forms on a vertically movable platform which could be raised by a suitable hoist. However, it was difficult to properly anchor this platform which was suspended by a cable or chain and to properly level and immobilize the interior forms during the concrete pouring operation. In order to do the job properly, many man hours were required and even then sometimes the results were less than totally satisfactory. Also, there were difficulties in forming the inside corners so that the forms could be retracted after the concrete was poured and set.

DISCLOSURE OF THE INVENTION

In accordance with this invention, a platform for supporting workman and/or materials is vertically movable within a previously formed shaft for an elevator or the like. The platform has means for raising and lowering it within the shaft. There are pocket means provided in each of the side walls and latch means in each of the edges of the platform. Means are also provided for extending the latch means into the pockets for supporting the platform at predetermined locations and for withdrawing the latch means from the pocket means to permit the platform to be raised or lowered within the elevator shaft. The vertically spaced pockets will be provided in each wall section of the elevator shaft as it is formed. Each pocket has a generally horizontal bearing surface extending into the side wall and a sloping upper wall extending from the inner edge of the support surface to the surface of the side wall above the bearing surface so that the pocket has a triangular configuration with the support surface forming the base thereof. The bearing surface includes a bed plate inserted imbedded in the side wall.

The latch includes a horizontal pivot pin mounted at the edge of the platform. The latch member having a generally flat support base is mounted on the pivot pin for pivotal movement between an extended position in which the latch member extends into the pocket with the support base resting on the support surface to hold the platform in a fixed vertical position within the shaft and a retracted position so that the platform can be raised or lowered within the shaft. A removable safety pin is also provided which extends through the platform at a position to prevent movement of the latch member from the extended position to the retracted position. A guide wheel is mounted on the pivot pin to guide the platform along the side walls. The center of gravity of the latch member is located inwardly of the pivot pin when the latch member is retracted so that when the latch member is aligned with the pocket the latch member swings from the retracted position to the extended position in the pocket. The latch member is provided which has a generally flat support base and is mounted on the pivot pin for pivotal movement between an extended position in which the latch member extends into the pocket with the support base resting on the support surface to hold the platform in fixed vertical position within the shaft and retracted position so that the platform can be raised or lowered within the shaft. An adjustable means is provided at each corner of the platform for supporting and leveling the inside form for the elevator shaft. Another adjustable means is provided for holding the forms in place.

The apparatus attached to each corner of the rectangular platform can be in an integral form which includes a horizontal foot for receiving the bottom of a stringer on the platform. A first vertical member extends upwardly from one end of the foot. A second vertical member is parallel and laterally spaced from the first vertical member and has one end attached to and extending upwardly from adjacent the other end of the foot. A top member generally extends parallel to the foot and has one end attached to the upper end of the first vertical member, the upper end of the second vertical member being attached to the top member intermediate the ends. A vertically adjustable support member attached to one end of the top member for supporting and leveling a form and a horizontally adjustable positioning device attached to the top member to hold the form into proper position prior to pouring concrete.

This apparatus can be used in connection with a novel method of constructing a rectangular shaft for elevators, stairways and the like having vertically spaced pockets formed in opposite side walls adjacent the corners thereof. This method comprises erecting wall forms to define the walls of the shaft. Rectangular openings are cut through the forms at the location of the pockets. A pocket is inserted through the openings which include a horizontal wall at the bottom of the pocket to define a horizontal support surface in the finished pocket. A steel bed plate is placed against the lower surface of the horizontal wall. A magnet is placed inside the pocket form so that it rests on the upper surface of the horizontal wall, the magnet being of sufficient strength to hold a bed plate in fixed position against the lower surface of the horizontal wall. The pocket form is attached to the wall form within the opening. Concrete is poured into the wall forms and around the pocket form. The concrete is cured to form a vertical wall section and the pocket form and magnet are removed from the wall form. The method can include the further steps of raising the forms by means of a platform within the shaft which has latches extending into pockets formed in the walls of the shaft, supporting the platform by latches in the pockets, and positioning the forms above the previously poured sections of the shaft for forming a new shaft section above the first shaft section.

The invention also contemplates a retractable corner mechanism for the inside corner of the concrete form. The mechanism comprises an elongated angle corner member having first and second perpendicular members whose outer faces form an inside corner of intersecting concrete walls and having form attaching means connected to the inner faces thereof. A concrete form has an end attached to each of the form attaching means. Means are provided for sliding the form attaching means relative to the corner member and means is provided for extending and retracting the forms to cause the corner member to be extended and retracted. The forms can be made of plywood or metal and the use of steel is contemplated for the corner members.

The retracting and extending means can include an externally threaded rod pivotally connected adjacent the end of one of the concrete forms and an internally threaded member pivotally connected adjacent the end of the other of the concrete forms and treadably received on the rod. Means is provided for rotating the threaded member on the rod to retract or extend the concrete forms.

More particularly, the corner members may be formed with first and second sides connected along one edge at right angles to each other which have outside surfaces to form the corner and inside surfaces. A plurality of vertically spaced plates extend across the flanges which are attached to the inside surfaces and have laterally spaced, vertical flanges. A pair of vertical rails are provided for engaging the adjacent edge of a concrete form panel. Each of the rails have an inwardly directed flange which is parallel with and contiguous to the gusset plate flanges. The inner end of the inwardly directed flanges are movable between an extended position wherein the surface of the concrete form panels and the surface of the first and second sides, respectively, lie in the same plane as the form panels and retracted position, wherein the surface of the concrete form panels are retracted from the surfaces of the first and second sides, respectively, and the inner ends of the flanges of the rails are in substantially abutting relationship. Fastening means extend through each of the gusset plate flanges to connect the inwardly directed rail flanges to the gusset plate flanges and a slot in each of the inwardly directed rail flanges is provided to facilitate lateral movement of the rail flanges with respect to the gusset plate flanges. Fastening means is provided at the upper and lower end of each corner member for connecting the two corner members together in end to end relationship. This fastening means can include a gusset having spaced openings and bolts extending through the openings of an upper gusset of one corner member and the openings of a bottom gusset of another corner member to secure the corner members together.

Additional advantages of this invention will become apparent from the description which follows, taken in conjunction with the accompanying drawings.

BEST MODE FOR CARRYING OUT THE INVENTION

Figure 1:
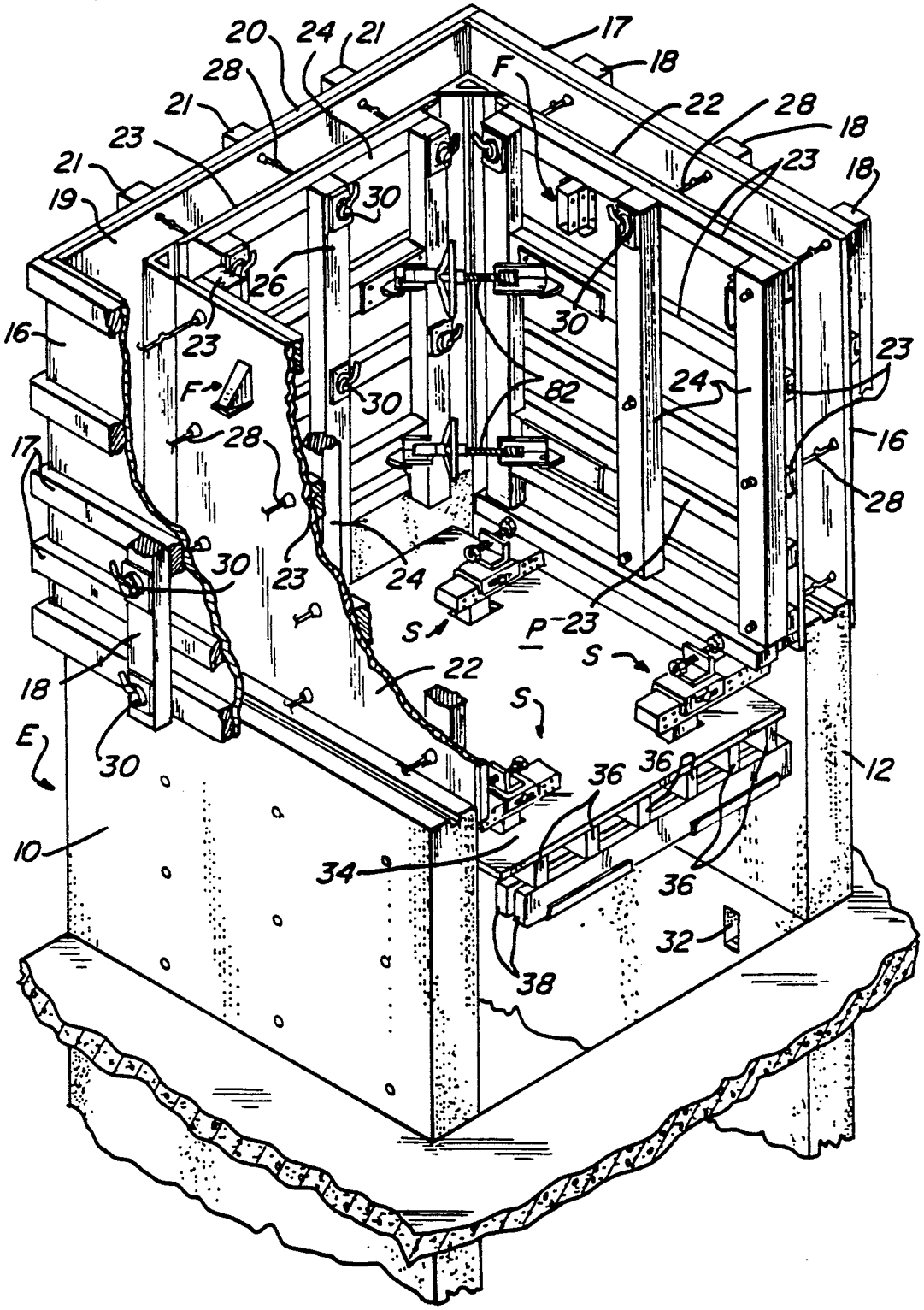
FIG. 1 is a perspective view of an elevator shaft utilizing the movable support mechanism of this invention to support and align interior forms, with parts broken away for clarity of illustration.
Figure 2:
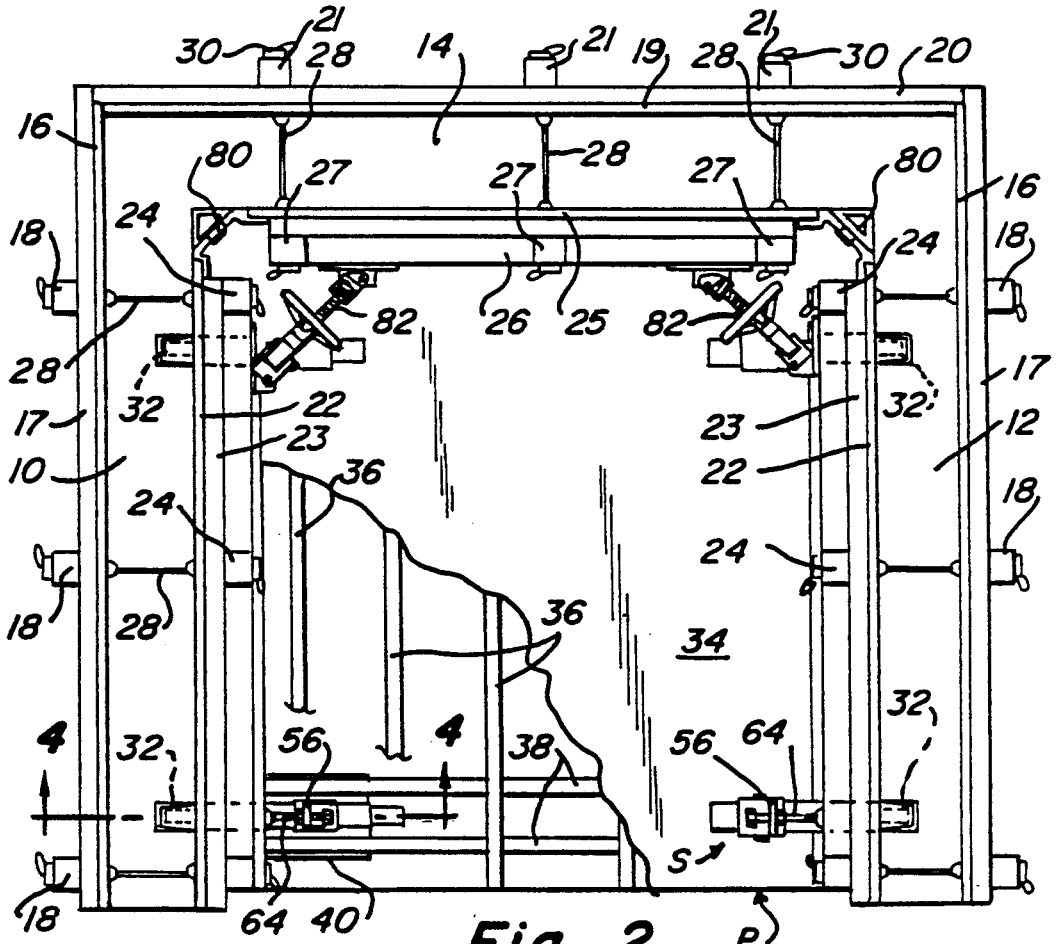
FIG. 2 is a top plan view of the shaft of FIG. 1 prior to positioning of the form ties, with a portion of the platform floor broken away to show further details of the invention.

In accordance with this invention, an elevator shaft E is constructed which includes opposed side wall sections 10 and 12 joined by a back wall section 14. Platform P is movable up the shaft as the wall sections are poured and supports and raises the interior forms. The corresponding exterior forms are supported by other portions of the building structure (not shown). The exterior forms include side form panels 16 reinforced by stringers 18 to which are attached walers 21. These side panels are joined by an outer rear panel 16 having stringers 20 and walers 21. The interior side form panels 22 each have transverse stringers 23 and vertical walers 24. Similarly, a rear inside panel form 25 is provided which extends between side panels 22 and includes transverse stringers 26 and vertical walers 27. Form ties 28 extend between the outer side form panel 16 and the inner side form panels 22 and are held in place by pivotal lock members 30, all as is conventional in the concrete forming art. Similarly, rear outer panel 20 and rear inner panel 25 are interconnected by form ties (not shown) and held in place by lock members 30. Each of side panel forms 22 include a pair of pocket forms F adjacent the upper corners thereof which form laterally spaced pocket means in the form of recesses 32 adjacent the upper corners of each side wall section 10 and 12. These recesses serve as supports for the platform P at each level of construction. This structure will be described more fully below. Platform P includes a floor 34 supported on joists 36 which in turn are supported on transverse stringers 38.

Figure 3:
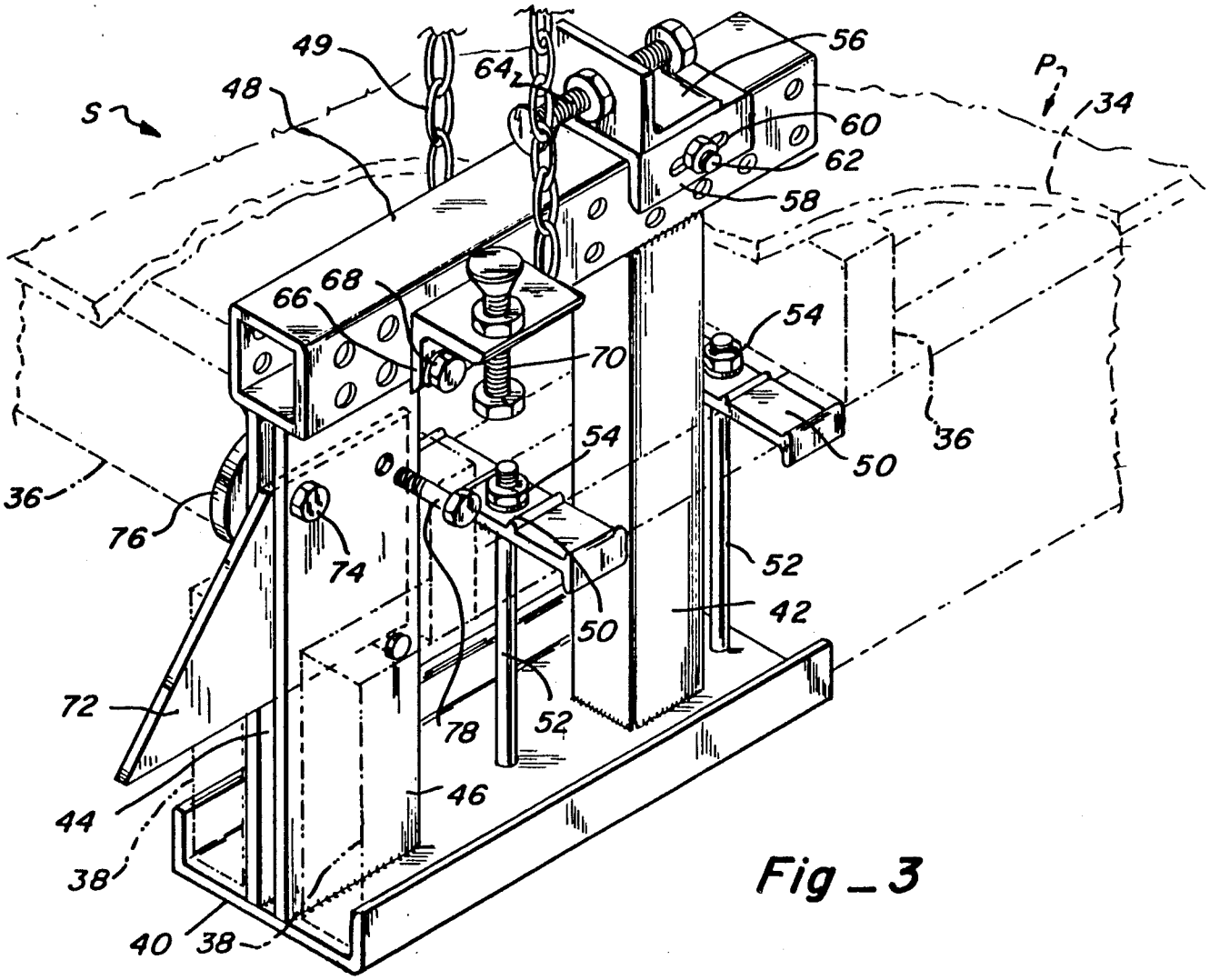
FIG. 3 is a fragmentary enlarged perspective view of one of the corner latch mechanisms of this invention showing its construction.
Figure 6:
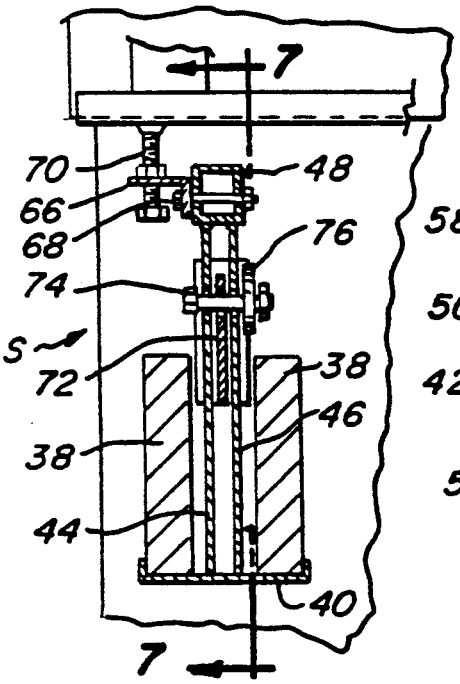
FIG. 6 is an enlarged vertical section, taken along line 6—6 of FIG. 4, showing additional details of the leveling mechanism and the latches for supporting the platform.

A support structure S supports the platform at each corner, as well as leveling, supporting and positioning the inner forms. Support structure S includes a channel shaped foot 40 which supports the outer most pair of stringers 38 at platform P. A first vertical member 42 in the form of a column extends upwardly from the base of channel 40, as best seen in FIG. 3. A second vertical member in the form of spaced plates 44 and 46 extend upwardly from the base of channel 40 at the opposite end thereof. The upper ends of these plates as well as column 42 are interconnected by a transverse tubular top member 48 which can be attached to the plates and the column, as by welding. Means for lifting platform P, such as chain 49 can extend around tube 48, as shown and be connected to a suitable hoist (not shown). The pair of stringers 38 are supported by the base of channel 40 on opposite sides of plates 44 and 46 and opposite sides of column 42, as shown. A pair of clamps 50 engage the tops of the stringers and are secured thereto, as by bolts 52 which extend upwardly through the base of the channel and through the center of the clamps. These bolts receive a nut 54 on the upper threaded ends thereof.

Mounted on top of tube 48 is a slidable bracket 56 which is attached, as by welding, to a U-shaped member 58 having a longitudinal slot 60 in the flanges thereof through which locking bolt 62 passes so that the bracket 56 can be positioned longitudinally along tube 48. A threaded stud 64 extends through an upturned flange of bracket 56 and is adjustable to hold the form in place, as best shown in FIG. 4.

Figure 4:
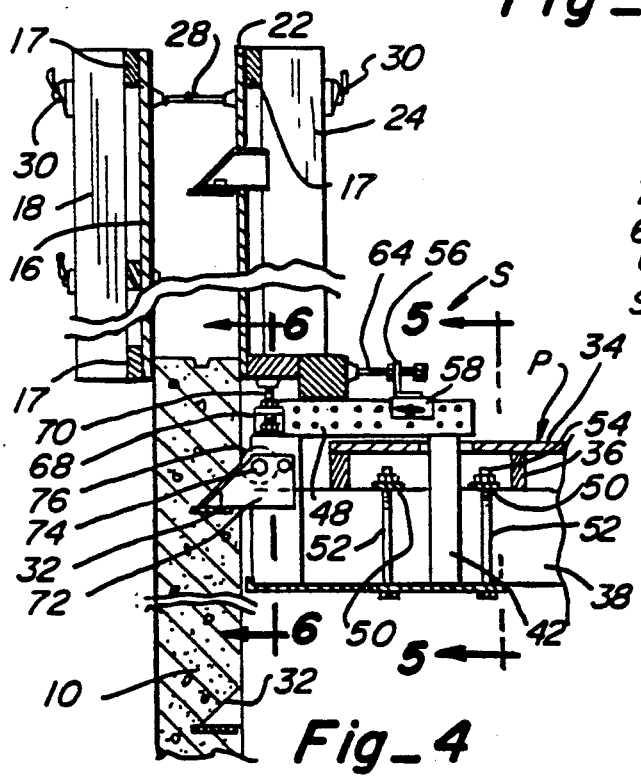
FIG. 4 is an enlarged vertical section, taken along line 4—4 of FIG. 2, showing the platform locking mechanism and the structure for holding the forms.
Figure 5:
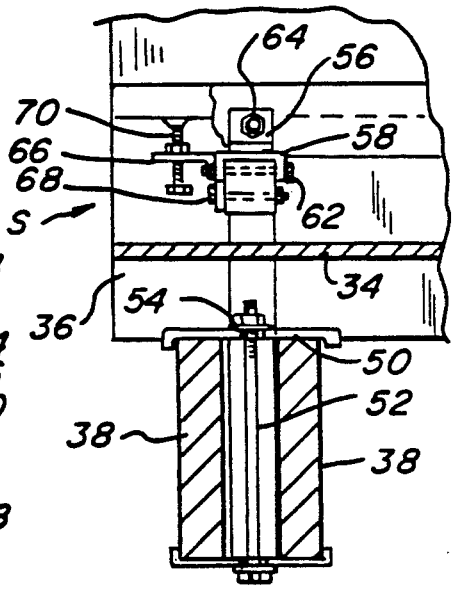
FIG. 5 is an enlarged vertical section, taken along line 5—5 of FIG. 4, showing further details of the mechanism for supporting and leveling the forms.

A second bracket 66 is attached by means of a bolt 68 to the side of tube 48 and has a vertical stud 70 which extends through the horizontal flange of the bracket for leveling the form panel, as best seen in FIGS. 4 and 5.

Figure 7:
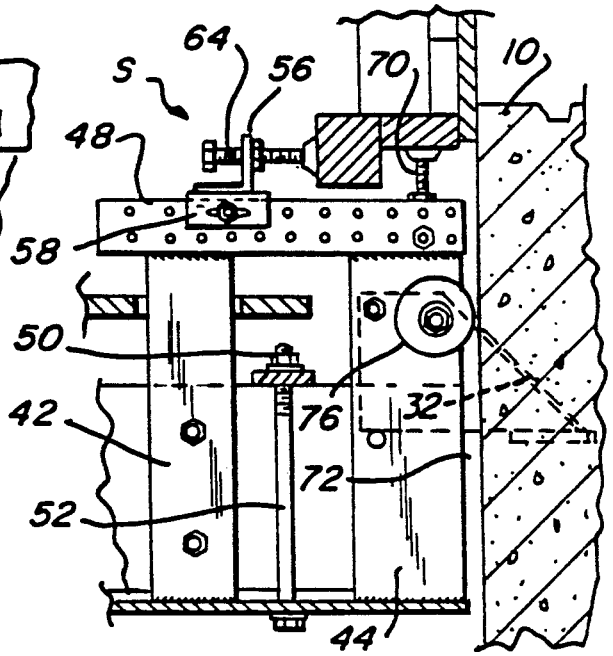
FIG. 7 is a vertical section, taken along line 7—7 of FIG. 6, showing additional details of the leveling mechanism and the latch mechanism.
Figure 8:
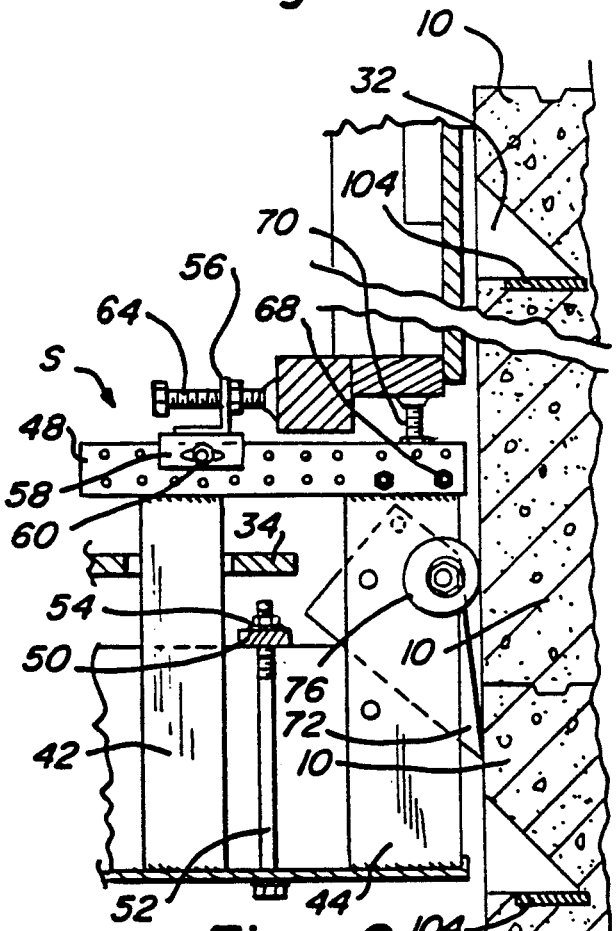
FIG. 8 is a fragmentary vertical section, similar to FIG. 7, but showing the platform being raised from one level to the next.

Conveniently, a latch plate 72 is mounted for pivotal movement between vertical plates 44 and 46 for pivotal movement about pin shaft 74. It can be seen that the center of gravity of latch plate 72 is inward of pivot pin shaft 74, it will tend to swing outwardly into an extended locking position under the influence of gravity. Conveniently, guide wheel 76 is also mounted on pin shaft 74 but outwardly of plate 44. When the latch plate is in the extended position, shown in FIG. 3, a safety bolt 78 can be inserted through apertures in the latch plate and vertical plates 44 and 46 to maintain the latch plate in extended locking position when it is inserted in a pocket 32 of a previously poured concrete wall section 10. When it is desired to move the platform from one level up to the next, i.e., from the position shown in FIG. 7, up through the position shown in FIG. 8, the safety bolt 78 will be removed and the latch plate will be pivoted inwardly by the newly poured concrete wall as the platform is lifted, as by a crane (not shown).

It will be understood that the support structure S just described will be provided at each corner of platform P and provides a means for locking the platform in recess 32 at one level while forms are positioned above the platform for pouring the next portion of the elevator shaft. After that portion has been poured and has cured sufficiently, safety bolts 78 are withdrawn and the platform is raised to the next level where the latches will be engaged with the next set of recesses 32. Conveniently, rear panel 25 and side panels 22 are interconnected at their corners by corner forms 80, the forms being held in place by a retractable corner mechanism 82 which is manufactured by Gates & Sons, Inc. of Denver, Colo. Thus, after a section has been poured and cured, the inner forms can be withdrawn inwardly and raised with the platform and the outer forms can be removed in a conventional fashion and reconstructed at the next higher level.

Figure 9:
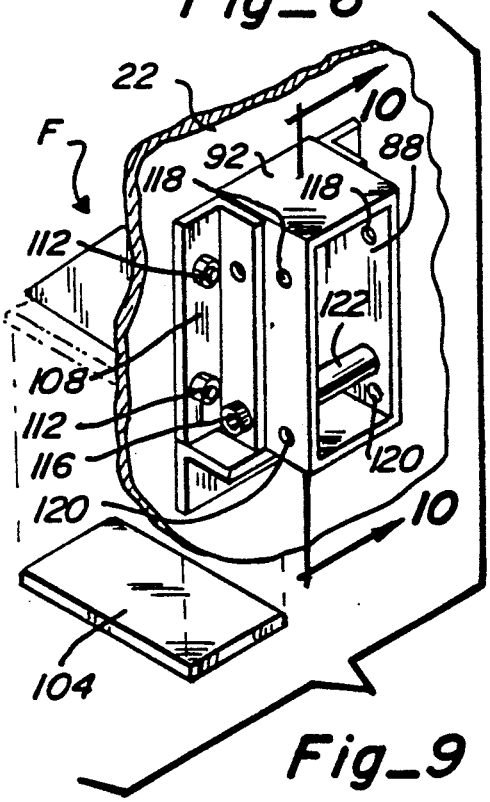
FIG. 9 is a fragmentary, exploded, perspective view showing the pocket construction in the form.
Figure 10:
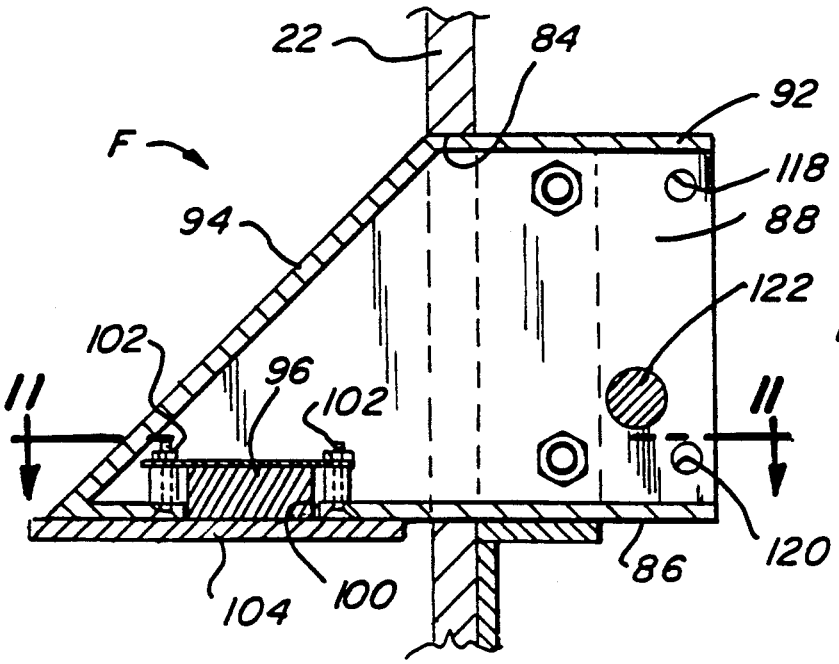
FIG. 10 is an enlarged vertical section, taken along line 10—10 of FIG. 9, showing further details of the pocket construction.
Figure 11:
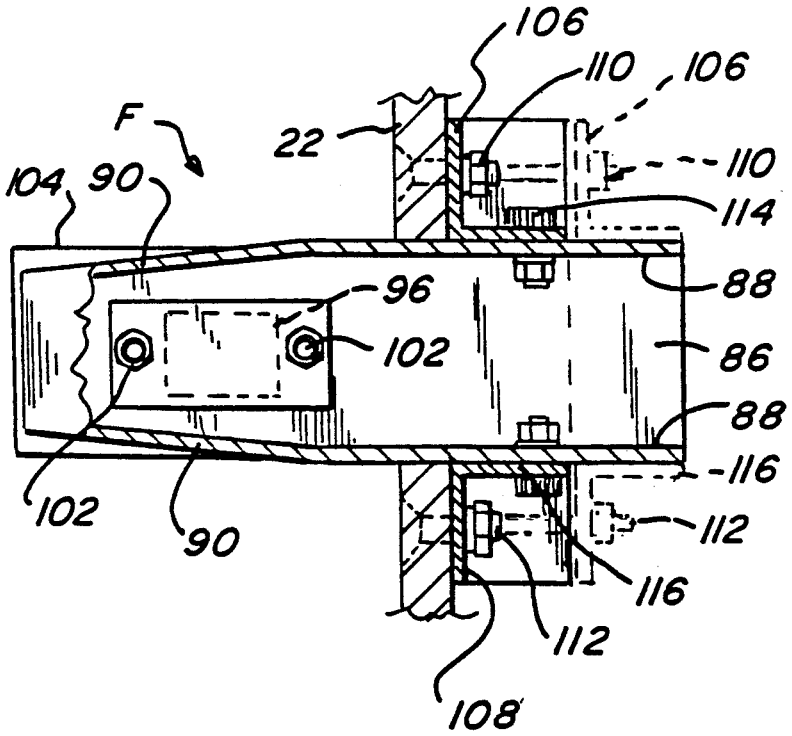
FIG. 11 is a horizontal section, taken along line 11—11 of FIG. 10, showing still additional details of the pocket construction.

As previously mentioned, each interior side form panel 22 includes two pocket forms F adjacent the upper corners thereof. These pocket forms are best seen in FIGS. 9–11. Each pocket extends through an opening 84 in panel 22 with a portion of the pocket form F extending outwardly of panel 22 and a portion thereof extending inwardly. The pocket form F is made of metal and includes a base plate 86 which extends through and rests on the lower portion of opening 84. Base 86 is formed integrally with vertical side walls 88 which have inwardly tapered portions 90 outwardly of panel 22. The pocket form F is completed by a top wall 92 and a downwardly sloping forward wall 94. The tapering of the outwardly extending portion of pocket form F facilitates removal of the form after the concrete is poured and cured.

A permanent magnet 96 extends through an opening 100 in base plate 86 and is mounted flush with the bottom of the base plate by means of mounting screws 102. An anchor plate 104 is held against base plate 86 by magnet 96 during pouring of the concrete. After the concrete is poured and cured, inner panels 22 are moved inwardly away from the adjacent side wall sections, the plate 104, which is now imbedded in the concrete at each recess 32, will remain in place. Since the magnet slides longitudinally along the face of plate 104 as pocket form F is withdrawn from recess 32 it will not offer substantial resistance to separation of the inner panels from the newly poured concrete wall. These anchor plates provide substantial support for latch plates 72 when the platform is moved up to the next level. If panel 22 is made of metal, the pocket form will be attached thereto by a pair of angles 106 and 108 which are attached to panel 22, as by bolts 110 and 112, respectfully, as shown in solid lines in FIG. 11. The flanges are connected to the side walls 88 of pocket form F by means of bolts 118 and 120, respectfully extending through a first pair of openings in the side walls. A second pair of openings 118 and 120 are provided and can be used for bolts 114 and 116 when a wooden panel 22 is used that has reinforcing timbers behind the opening making the total thickness of the form greater. In this situation, angles 106 and 108 are in the dotted line position shown in FIG. 11.

A rod 122 extends transversely between side walls 88 and is welded thereto. This rod can be engaged by the end of a crowbar to help dislodge the pocket forms F from the recesses 32 after the concrete has cured.

Figure 12:
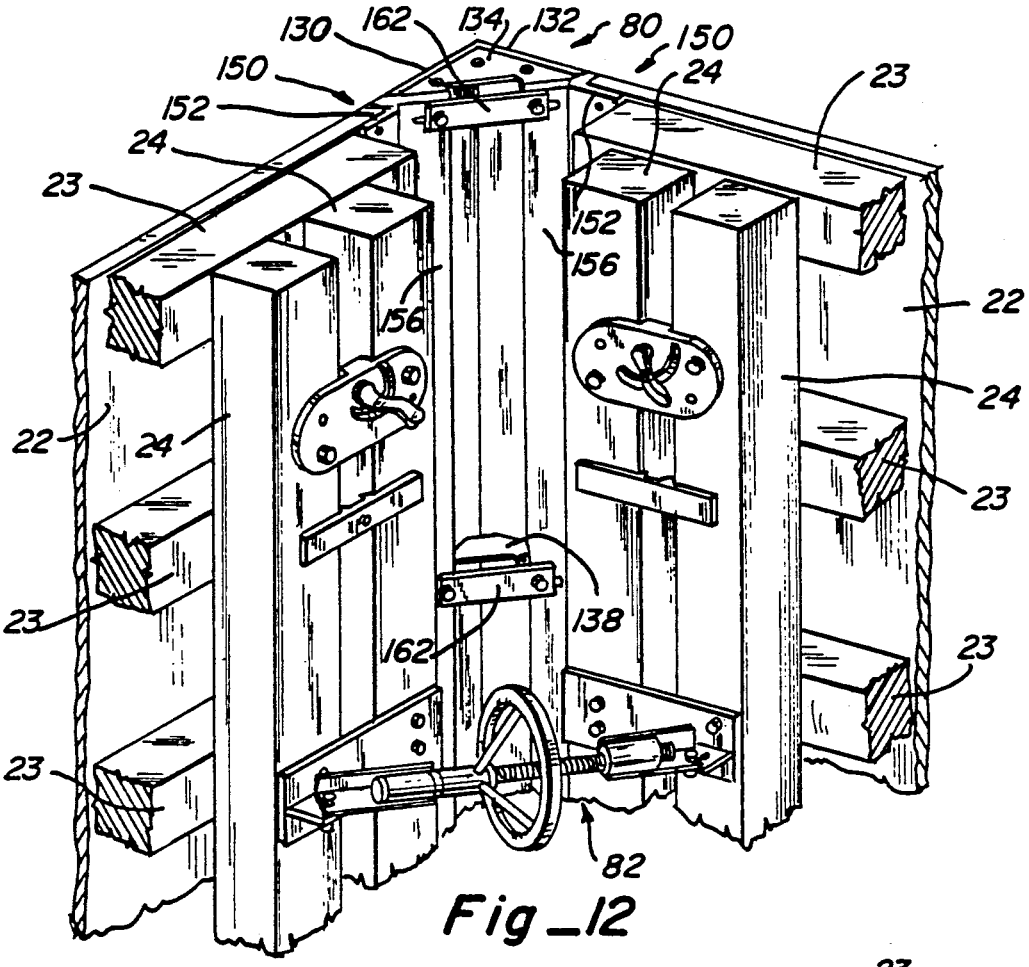
FIG. 12 is an enlarged fragmentary view of the retractable corner mechanism of this invention.
Figure 13:
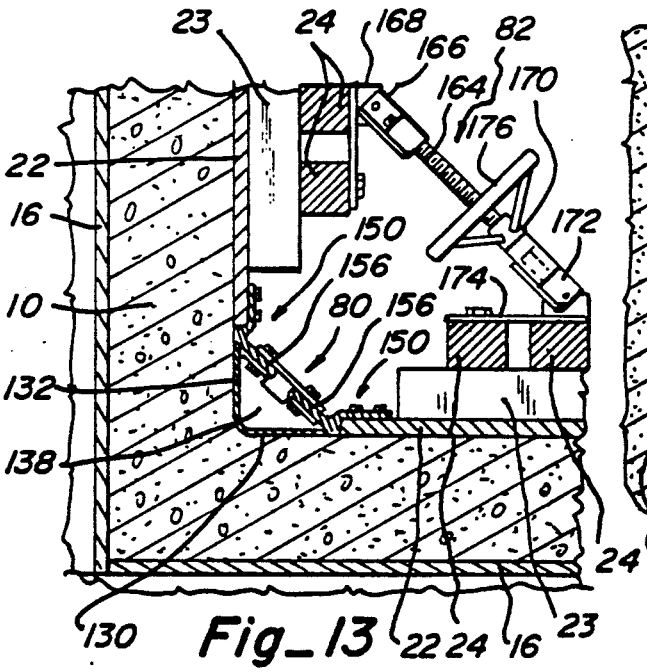
FIG. 13 is a horizontal section, through a corner wall showing additional details of the retractable corner mechanism.
Figure 14:
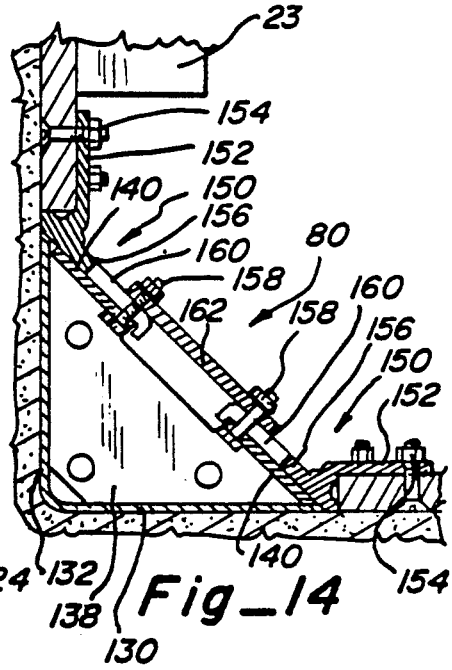
FIG. 14 is an enlarged fragmentary view of a portion of FIG. 13 showing additional details.
Figure 15:
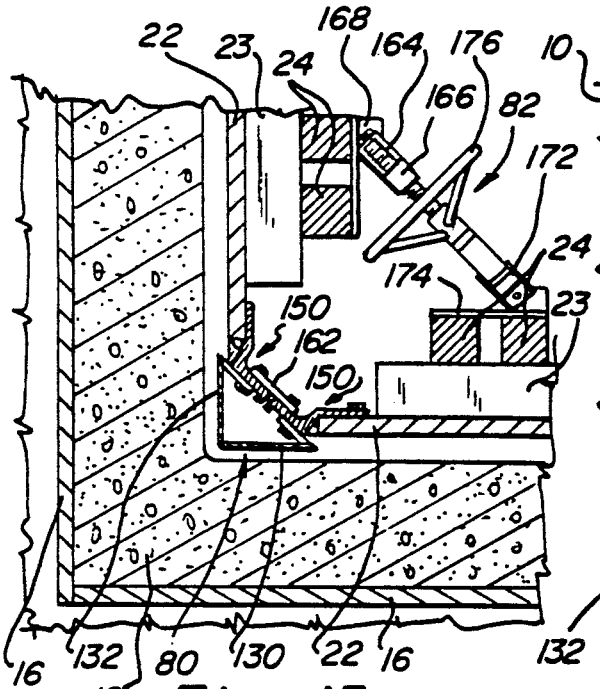
FIG. 15 is a wall section, similar to FIG. 13 but showing the retractable corner mechanism in retracted position.
Figure 16:
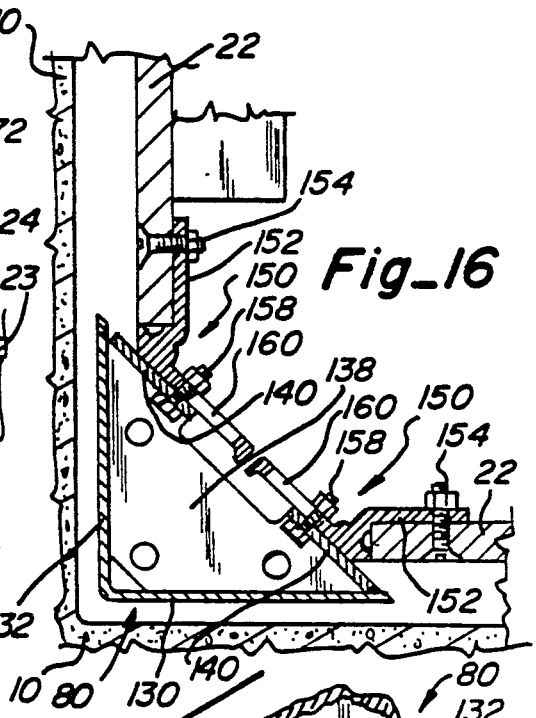
FIG. 16 is an enlarged fragmentary section of a portion of FIG. 15 showing additional details.
Figure 17:
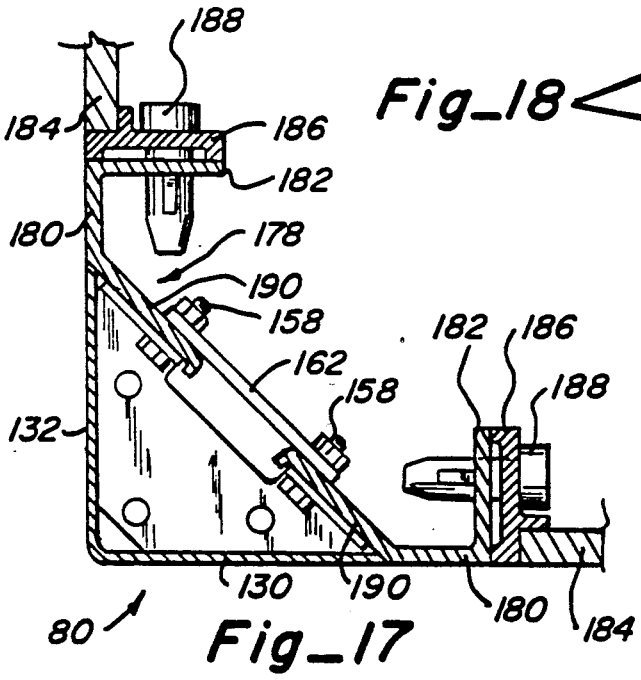
FIG. 17 is a vertical section through an alternative form of retractable corner mechanism.
Figure 18:
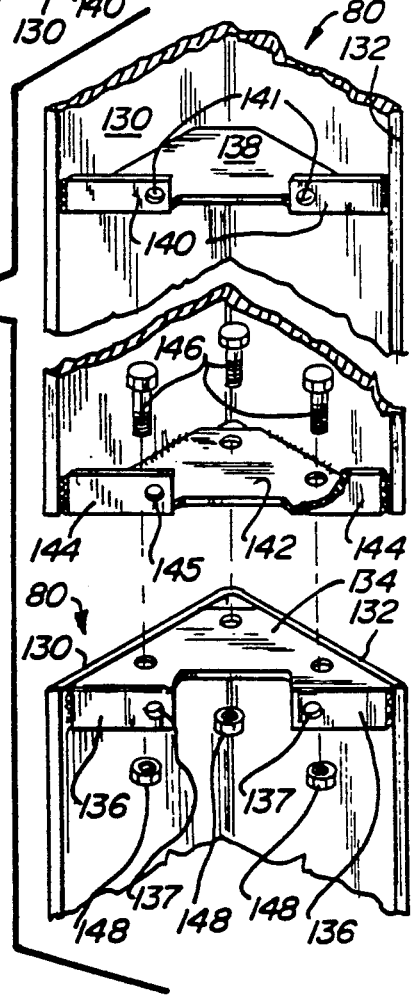
FIG. 18 is a fragmentary exploded view showing the interconnection between two corner form members.

Turning to FIGS. 12–18, the specific structure of the corner forms 80 and the retractable mechanism 82 will be described. As best seen in FIG. 12–14, corner form 80 includes outer surfaces 130 and 132 which are formed at right angles with respect to each other. The corner forms 180 are reinforced by vertically spaced gusset plates, such as an upper gusset plate 134 having a pair of down turned flanges 136 with openings 137 therein as best seen in FIG. 18. A center gusset plate 138 has a pair of up turned flanges 140 having openings 141 therein. At the lower end of corner form 80 is a bottom gusset plate 142 having up turned flanges 144 with openings 145 therein.

As best seen FIG. 18, the corner forms may be vertically stacked by attaching the upper gusset 134 of one corner form to the bottom gusset 142 of another corner form, as by means of bolts 146 and nuts 148.

A pair of rails 150, which may be made as an extrusion, have a first flange 152 attached to the edge of form panel 22 by bolts 154. The rail 150 has a second flange 156 attached to the respective flanges of the gusset plates as by spaced bolts 158 which extend through the holes 141, 145 and 148 of the respective gusset plates 138, 142 and 134. The bolts also extend through slots 160 in flanges 156. Finally, the bolts extend through openings in spacer plates 162, as shown.

The corner forms 80 are shown in FIGS. 13 and 14 in the proper position during pouring of the concrete. After the concrete has cured, the forms are retracted to the position shown in FIGS. 15 and 16. The mechanism for retracting the corner form 80 and the panels 22 includes an externally threaded rod 164 having one end mounted in a bracket 166 pivotally mounted on support 168 attached to whalers 24. The other end of rod 164 is threadably received in an internally threaded sleeve 170 which is attached to a bracket 172 pivotally mounted on support 174 attached to whalers 24 of the other form panel 22. Wheel 176 is mounted on sleeve 170 for rotating the sleeve on bracket 172 so as to draw rod 164 into the sleeve to retract the forms to move them from the position shown in FIGS. 13 and 14 to that shown in FIGS. 15 and 16. Of course, when the forms are ready to be reused the wheel can be turned in the opposite direction to extend the forms to the appropriate position. As the forms are withdrawn, it will be noted by viewing FIGS. 15 and 16, the form panels 22 move twice the distance of corner form 80 and brackets 150 slide along slots 156 so that they are moved into nearly abutting relationship.

An alternative embodiment is shown in FIG. 17 wherein the corner form 80 is used with steel forms of the type made by Symons and Patent. Like references numerals represent like parts. In this embodiment, the rails 178 are provided, each of which has a first flange 180 which is coplaner with surface 132 of corner form 80 on one side and coplaner with surface 130 on the other side and terminates in an inwardly projecting lip 182. The forms 184 are provided with metal frame members 186. The metal frame member mates against lip 182 and each has a slot for receiving a lock pin 188. Rails 178 are also provided with a second flange 190 which has slots, similar to slots 160 of the previous embodiment, for receiving bolts 178 in sliding relationship so that the forms can be extended and retracted, as previously described.

From the foregoing, the advantages of this invention are readily apparent. A movable platform has been provided which includes releasable latch devices that can be locked into recesses in previously poured portions of an elevator shaft or stairway shaft and support the inner form panels while additional upper sections are poured. These form panels include pocket forms which create the recesses in the next poured wall section which will be used by the platform when it is raised to the next level. The latch mechanism for supporting the platform can be securely locked in place when it is being used but the latches are made so that they can swing inwardly when the safety pins are withdrawn. Conveniently, the latches are constructed and mounted so that their center of gravity is off center from the pivot point causing them to swing into open position. Guide rollers are also provided which allow the platform to be raised without scratching or marring the newly poured concrete after the form panels are removed and during raising of the platform to the next level.

It will be understood that although an elevator shaft has been shown for use with a single elevator that the shaft could be much wider to accommodate a plurality of elevators. Also, the construction could be used in connection with a stairway wherein a panel would be put on the fourth open side to form a closed rectangular shaft. In this case, doorways could be formed into the panels, as required at each floor level.

As will be readily apparent, with the retractable corner mechanism as described in this invention, a concrete wall corner can easily be poured and the forms easily put in place before pouring and easily retracted after curing for movement to the next corner to be formed. This is possible because of the provision of rails which are slidable along the back surface of the corner forms in response to threaded members which can be rotated with respect to each other to move the forms further apart or draw them closer together.

This invention has been described in detail with reference to particular embodiments thereof, but it will be understood that various other modifications can be effected within the spirit and scope of this invention.

I claim:

1. A retractable corner mechanism for the inside corner of a concrete form, said mechanism comprising:

an elongated angle corner member having first and second perpendicular members whose outer faces form the inside corner of intersecting concrete walls and having form attaching means connected to the inner faces thereof;

a concrete form having an end attached to each of said form attaching means;

means for sliding said form attaching means outwardly and inwardly relative to said corner members; and means for extending and retracting said forms to cause said corner members to be extended and retracted in response to sliding of said form attaching means relative to said corner members.

2. Apparatus, as claimed in claim 1, wherein:

said forms are plywood.

3. Apparatus, as claimed in claim 1, wherein:

said forms are metal.

4. Apparatus, as claimed in claim 1, wherein:

said corner members are steel.

5. Apparatus, as claimed in claim 1, wherein said retracting and extending means comprises:

an externally threaded rod pivotally connected adjacent said end of one of said concrete forms;

an internally threaded member pivotally connected adjacent said end of the other of said concrete forms and threadably received on said rod; and means for rotating said threaded member on said rod to retract or extend said concrete forms.

6. Apparatus, as claimed in claim 1, wherein said form attaching means comprise:

vertically spaced, generally triangular gusset plates having first and second sides affixed to said inner faces thereof and a pair of flanges extending perpendicularly from the third side thereof;

a pair of side rails, each rail having a first side flange for attachment to said concrete form and an opposite second side flange having lateral slots vertically spaced to be in contiguous relationship to said respective gusset plates; and fasteners extending through said gusset plate flanges and said slots to facilitate sliding movement of said rails with respect to said gusset plate flanges so that said rails can move between an extended and retracted position along said slots.

7. A retractable corner mechanism for the inside corner of a concrete form, said mechanism comprising:

first and second sides connected along one edge at right angles to each other which ave outside surfaces to form the corner and inside surfaces;

a plurality of vertically spaced gusset plates extending between said first and second sides, which are attached to said inside surfaces and have laterally spaced, vertical flanges;

a pair of vertical rails for engaging the adjacent edge of a concrete form panel, each of said rails having an inwardly directed flange which is parallel with and contiguous to one of said gusset plate flanges; and means interconnecting said inwardly directed flanges of said vertical rails and said vertical flanges of said gusset plate flange, respectively, for moving said rails between an extended position and a retracted position.

8. Apparatus, as claimed in claim 7, further including:

fastening means extending through each of said gusset plate flanges to connect said inwardly directed rail flanges to said gusset plate; and a slot in each of said inwardly directed rail flanges to facilitate lateral movement of said rails with respect to said gusset plate flanges.

9. Apparatus, as claimed in claim 8, further including:

a spacer plate extending across and connected to said fastening means.

10. Apparatus, as claimed in claim 7, further including:

fastening means at the upper and lower end of each corner member for connecting two corner members together in end to end relationship.

11. Apparatus, as claimed in claim 10, wherein each said fastening means includes:

a gusset having spaced openings; and bolts extending through said openings of an upper gusset of one corner member and the openings of a bottom gusset of another corner member to secure the corner members together.

* * * * *

UNITED STATES PATENT AND TRADEMARK OFFICE

CERTIFICATE OF CORRECTION

PATENT NO. : 5,088,578

DATED : February 18, 1992

INVENTOR(S) : H. Gordon Gates

It is certified that error appears in the above-identified patent and that said Letters Patent is hereby corrected as shown below:

Column 9, Line 17, delete "ave" and insert --have--.

Signed and Sealed this

First Day of June, 1993

*Attest:*

Michael K. Kirk

MICHAEL K. KIRK

*Attesting Officer*

*Acting Commissioner of Patents and Trademarks*